United States Patent [19]

Sparkman

[11] Patent Number: 4,999,919

[45] Date of Patent: Mar. 19, 1991

[54] PIN GUARD BOW SIGHT

[76] Inventor: Frank Sparkman, 3114 Escalante, Idaho Falls, Id. 83404

[21] Appl. No.: 552,114

[22] Filed: Jul. 13, 1990

[51] Int. Cl.[5] ..... F41G 1/467

[52] U.S. Cl. ..... 33/265; 124/87

[58] Field of Search ..... 33/265; 124/87, 88

[56] References Cited

U.S. PATENT DOCUMENTS

| | | | |
|---|---|---|---|
| 3,136,063 | 6/1964 | Stebbins | 124/87 |
| 3,670,422 | 6/1972 | Stebbins et al. | 33/265 |
| 3,715,807 | 2/1973 | Heffer | 33/265 |
| 4,136,462 | 1/1979 | Topel | 33/265 |
| 4,167,333 | 9/1979 | Young et al. | 33/265 |
| 4,535,747 | 8/1985 | Kudlacek | 124/87 |
| 4,543,728 | 10/1985 | Kowalski | 33/265 |

*Primary Examiner*—Thomas B. Will

*Attorney, Agent, or Firm*—Robert A. de Groot; Stephen A. Gratton

[57] ABSTRACT

An archer's bow pin sight device having a combination of vertical bands and horizontal bands in conjunction with typical sight pins commonly used on bows, so as to provide bracketing lines on either side of sight pins and target or bracketing lines above and below the pin and target or both side and top and bottom.

7 Claims, 4 Drawing Sheets

PIN GUARD BOW SIGHT

BACKGROUND OF THE INVENTION

This invention relates to an archer's multipurpose bow-sighting device that can be used as a cross-hair sight when used with conventional sight pins or as a bracketing sight, i.e. a pair of vertical members bracket the sight pin. It can also be adapted to provide a box sight, i.e. vertical bracket members and horizontal bracket members.

There are a multitude of sights available for archers' bows. The sight is typically mounted on a bracket which is fastened to the bow above the hand grip and arrow rest. It is typically used in conjunction with a peep sight accurately located on the bow draw string. Some of the types of sights include: a multi-pin sight having four or five pins, a multi-pin sight with a U-shaped pin guard protecting the pins, a multi-pin sight having a single vertical cross-hair, and various combinations of the above.

For instance, U.S. Pat. No. 4,136,462 discloses an adjustable cross-hair sight having the single vertical wire and a plurality of horizontal wires. The single vertical wire is mounted on a bracket that is adjustable horizontally thereby varying the distance between the vertical wire and the bow. This adjustment provides a sideways or windage adjustment and is accomplished by rotating a top and bottom bracket backing nut, a typical vertical cross-hair adjustment method. The problem with two adjusting nuts is that the bracket may become canted if the nuts are unevenly adjusted. The range adjustment is accomplished by moving the horizontal wires or pins up or down after loosening a set screw, a method common in the art.

It is the purpose of this invention to provide an easily adjustable pair of vertical cross-hairs that can be used to bracket the target, i.e. center the target between the vertical lines. A single knurled knob adjusts both hairs. It is also possible to "box" the target by attaching a pair of horizontal cross-hairs, retained between the pin guard and the bracket; and when used with the vertical cross-hairs, the target may be centered within the "box".

SUMMARY OF THE INVENTION

The invention incorporates a pair of flexible bands, such as rubber bands, attached between an upper and lower drive screw which in turn has an archer's bow pin guard inserted through the center of each screw. The U-shaped pin guard is mounted on a bracket that attaches to the bow above the hand grip and arrow rest. A pair of collets retain each screw on the upper and lower portions of the pin guard, allowing rotational motion of each screw about its longitudinal axis. The threaded ends of the upper and lower position of the pin guard are affixed to the bow bracket by conventional fastener consisting of knurled finger nuts, flat and lockwashers, hex nut, and square nuts matching the No. 8–32 thread of the threaded ends of the pin guard. Two flexible members or rubber bands are placed over the screw threads at an approximate 3/16" vertical distance from each other such that they are parallel to the vertical portion of the pin guard and also the bow. Rotation of either of the screws causes the rubber bands to travel horizontally back and forth over the screw threads. The preferred location is having the sight pin points centered between the flexible members so as to "bracket" the pin. The drive screws can be fixed by tightening an Allen head socket set screw on each.

In another embodiment, a single band may be used after removing one band and aligning the remaining band in the center of the pin aim point, tightening the set screws, and then adjusting the sight pins about 5/16" away from the bow to make a cross-hair sight. A special pin having a slender elongated section is provided to perform this horizontal "cross-hair" function. This pin consists of a standard No. 8–32 threaded pin about 2" in length with a straight pin of about $\frac{5}{8}$" length and 0.03" diameter (straight pin size) extending from the end of the threaded section. The straight pin has a colored bulb at the end for use as a pin sight. As an alternate, the pin may be removed and a horizontal band installed between the vertical pin guard post and the bracket. The vertical pin guard is notched at typically 1/32" intervals to maintain the rubber band in the selected horizontal positions.

DETAILED DESCRIPTION OF THE INVENTION

Figures 1, 2:
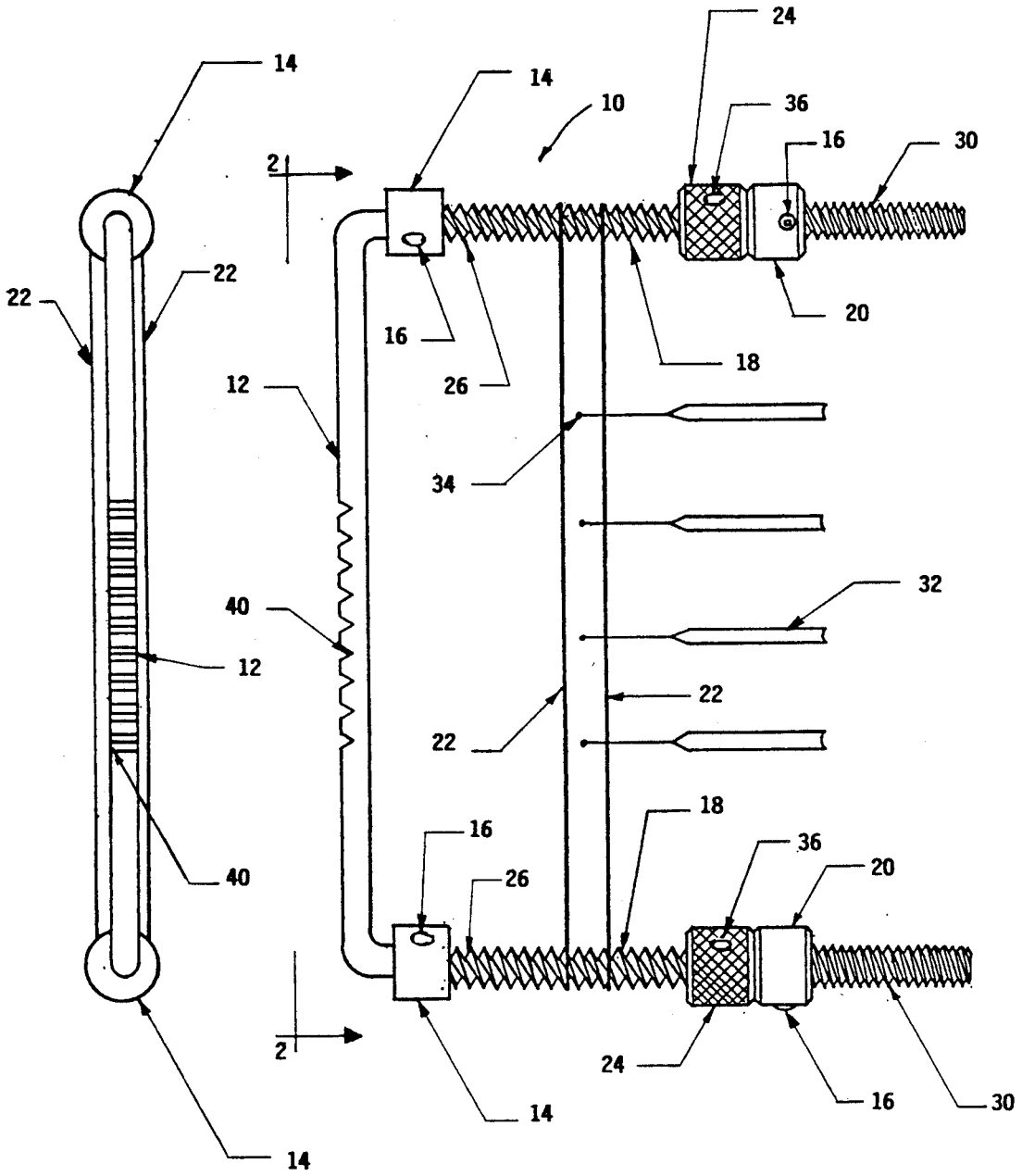
FIG. 1 is a side elevation of the bow pin sight.
FIG. 2 is an end view taken along line 2—2 of FIG. 1.

FIG. 1 illustrates the preferred embodiment of the pin guard bow sight generally indicated as 10. The pin guard 12 has an upper and lower collet 14 held in place over the pin guard 12 by Allen set screws 16. Adjacent the collets are a pair of drive screws 18 also having a longitudinal bore to allow the pin guard to pass through and allowing rotation of the drive screws 18. Each drive screw 18 is retained in position by a second pair of collets 20. A pair of vertical flexible members (rubber bands) 22 is installed over the drive screws at a distance of about 3/16", or 5 threads. Rotation of knurled portion 24 of the drive screws 18 causes the rubber bands 22 to travel left or right over the threaded portion 26. The pin guard 12 is attached to a bow bracket (not shown), well known in the art, by fasteners, such as nuts, lockwashers, etc. (not shown) and threads 30 of the pin guard 12. Also mounted by threads to the bracket are the sight pins 32 having an elongated aim point and pin head 34. The vertical rubber bands 22 are adjusted so that pin head 34 is centered between the bands and then secured by tightening set screws 36.

Figure 3:
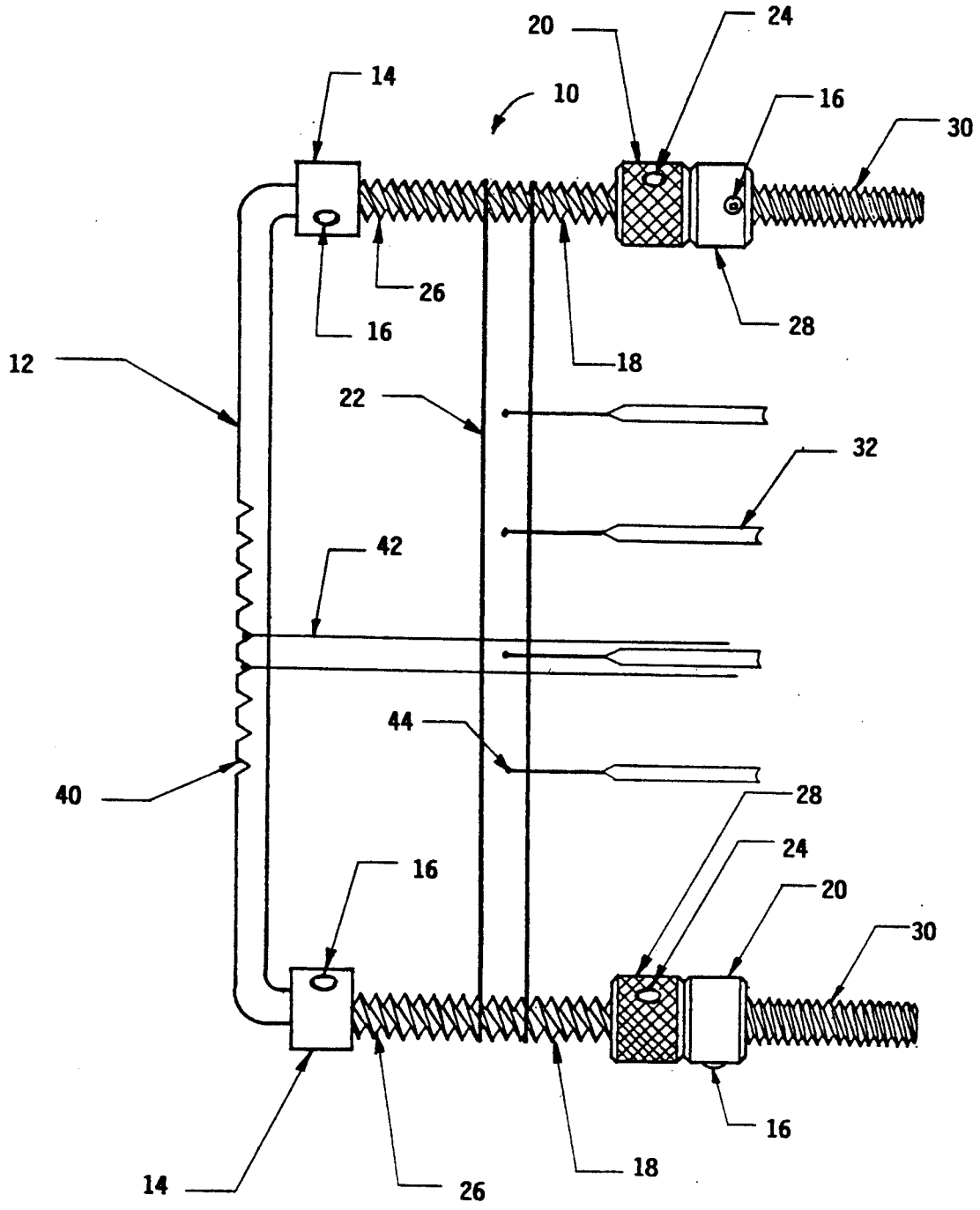
FIG. 3 is a side elevation of a "boxed" aim point.

FIG. 2 illustrates an end view of the pin guard showing grooves 40 on the vertical face of pin guard 12. The function of these will be seen by referring to FIG. 3, an embodiment of the present invention. This figure shows a pair of horizontal rubber bands 42 installed over pin guard 12 in the grooves 40. The opposite end of the band 42 goes around the bow bracket (not shown) and the bands 42 are adjusted to center the pin head within "box" 44. They are easily relocated to a different range sight pin, i.e. upper or lower, by moving to a higher or lower groove.

Figure 4:
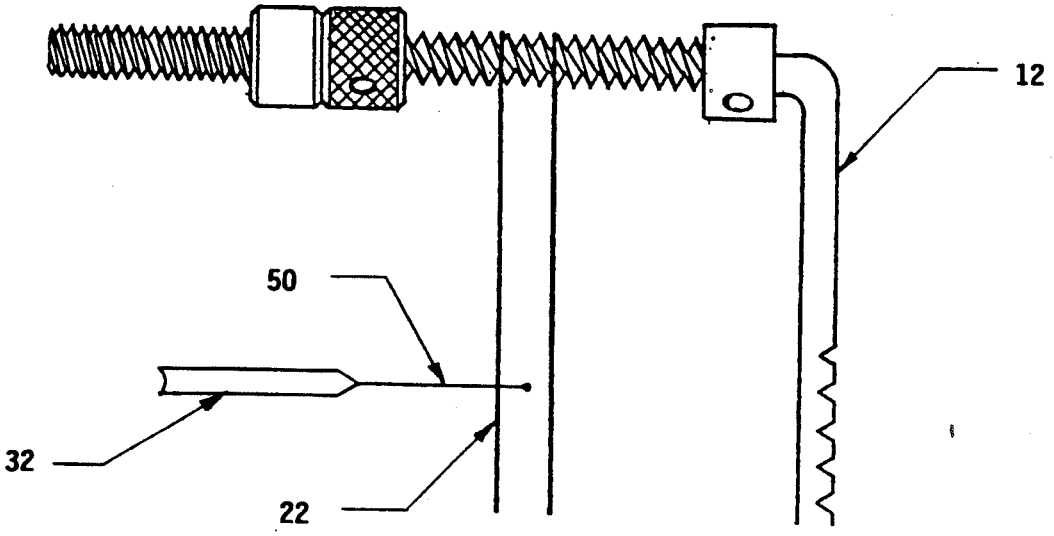
FIG. 4 is a side elevation of a further embodiment of the invention.

FIG. 4 illustrates a cross-hair type of sight wherein the single rubber band 22 is used in conjunction with pin 32 to form an aim point at 50.

Figure 5:
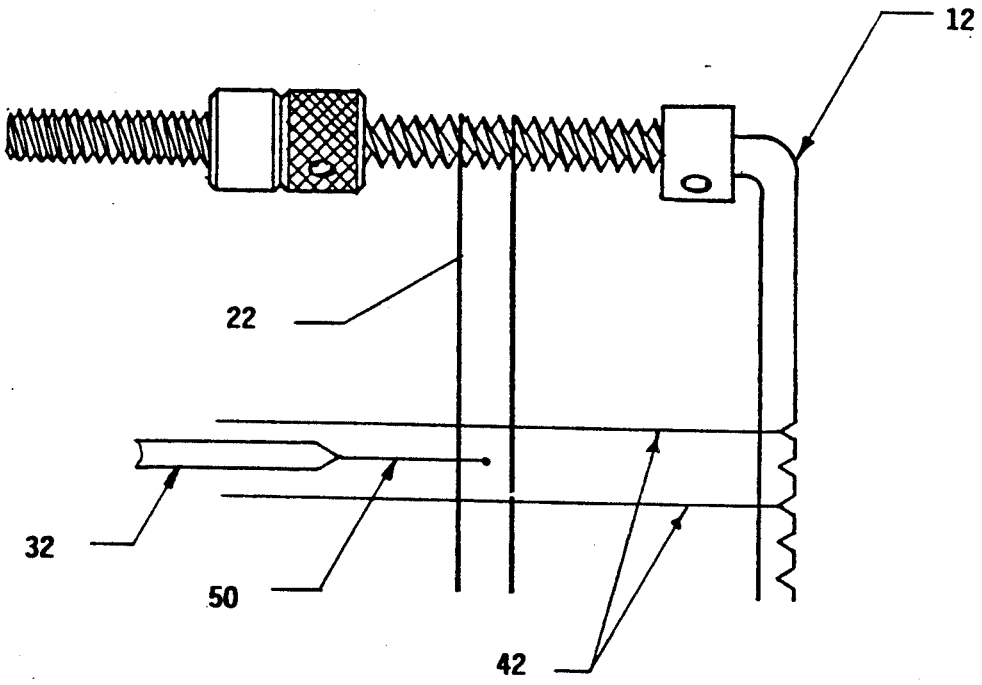
FIG. 5 is a side elevation of another embodiment of the invention.

FIG. 5 illustrates a further embodiment of the cross-hair sight using pin 32, band 22, and horizontal bands 42 to bracket the pin and aim point 50 with the bands 42.

Figure 6:
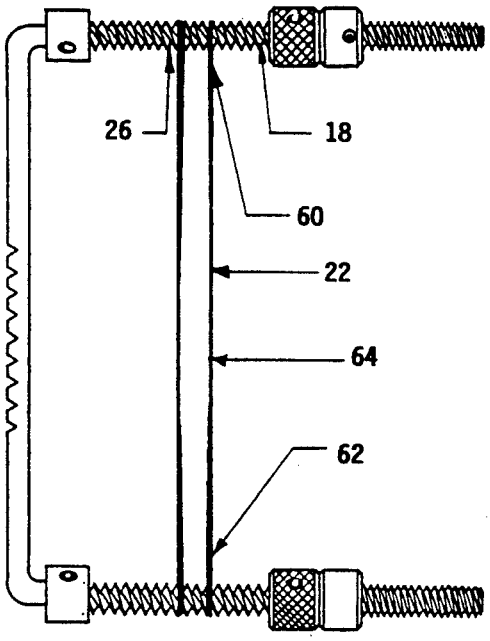
FIG. 6 is a side elevation of the bow sight, properly aimed.
Figure 8:
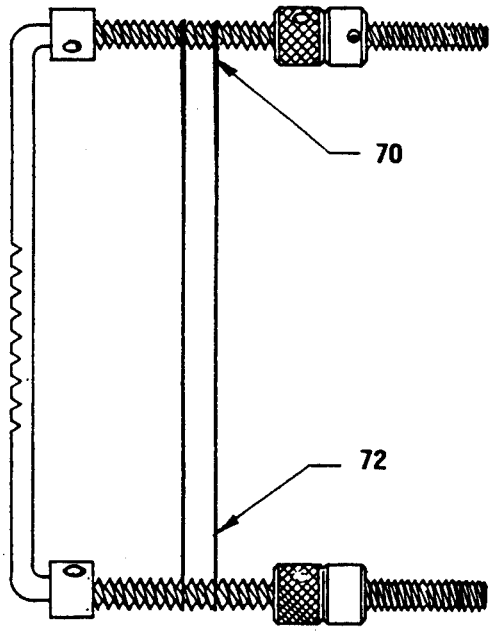
FIG. 8 is a side elevation of the bow sight, improperly aimed.
Figure 7:
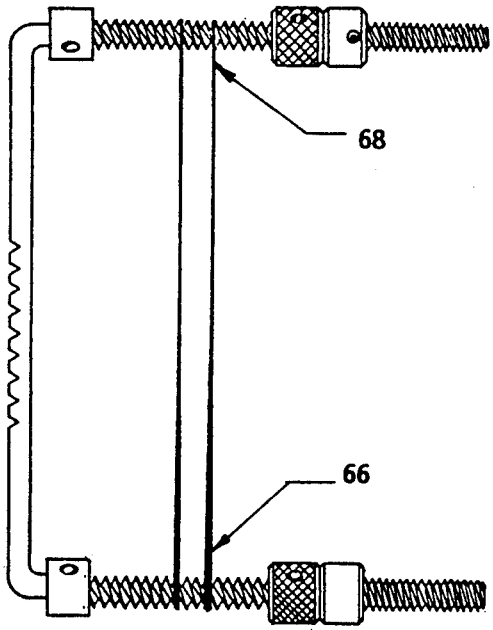
FIG. 7 is a side elevation of the bow sight, improperly aimed.

A novel feature of the sight can be seen in FIGS. 6, 7, and 8 that is due to the thread pitch of drive screw 18. The model shown has a No. 10–24 thread 26, i.e. 24 threads per inch; and because rubber bands 22 span one-half a thread, the back portion of rubber band 22 (behind the drive screw) is a little less than 1/32 of an inch to the left of the front portion of the band at the upper screw 18, as illustrated at 60. At the bottom 62 of the bands, the reverse is true, and the back band portion is less than 1/32" to the right of the front portion.

Referring to FIG. 6, it should be noted that for a properly adjusted sight and an accurately pointed bow at the top 60 and bottom 62 both bands (front and back) will be visible; whereas at center 64, only one band will be visible and this will appear to be a thin line. In this case, the upper 60 and lower portions 62 will appear thicker.

In contrast, referring to FIG. 7, the archer is shooting to the right and the thicker silhouette appears at bottom 66 and thinner silhouette appears at top 68. Finally, when the archer is shooting to the left, the thicker silhouette will appear at top 70 in FIG. 8, and the thin silhouette will appear at bottom 72. Consequently, for highly accurate sighting, such as target shooting, the sight gives indication to the archer of proper or improper aim, i.e. proper aim is illustrated by FIG. 6.

A further advantage of the vertical bands is that they can be lined up with vertical objects, such as trees, target sides, etc., to keep the bow in a vertical position, which is required for accurate shooting.

While a preferred embodiment of the invention has been disclosed, various modes of carrying out the principles disclosed herein are contemplated as being within the scope of the following claims. Therefore, it is understood that the scope of the invention is not to be limited except as otherwise set forth in the claims.

I claim:

1. An archer's bow sight comprising:

a. a pin guard affixed to a bracket said pin guard having upper and lower sections connected by a vertically extending section, said bracket adapted to be mounted on a bow;

b. a first pair of collets mounted on the upper and lower section of the pin guard;

c. a pair of drive screws having a longitudinal bore to allow the upper and lower sections of the pin guard to pass through and mounted on said sections adjacent the first pair of collets;

d. a second pair of collets mounted adjacent the drive screws retaining the drive screws on the pin guard;

e. at least one flexible band installed over a threaded portion of each drive screw to extend substantially parallel to the vertical section of the pin guard; and f. a plurality of sight pins affixed to the bracket each having an elongate section and a pin head, such that the flexible band may be centered at a middle portion of the elongate pin section forming a cross-hair for sighting a target by rotation of one drive screw.

2. The sight as recited in claim 1 wherein a second flexible band is installed over the drive screws and adjusted to form a bracket on either side of the pin head by rotation of the drive screws.

3. The sight as recited in claim 2, wherein the vertical section of the pin guard is grooved at fixed intervals to receive a horizontally mounted pair of flexible bands, so as to box the pin head and the target.

4. The sight as recited in claim 1 wherein the vertical section of the pin guard is grooved at fixed intervals to receive a horizontally mounted pair of flexible bands, so as to bracket the cross-hair.

5. The sight as recited in claim 1, wherein the drive screws and flexible band may be fixed by tightening a set screw in each drive screw affixing it to the pin guard.

6. The sight as recited in claim 1, wherein the sight pin elongate section is about 5/8" and 0.03" in diameter.

7. An archer's bow pin guard sight mounted on a bracket wherein the improvement comprises:

a. a pin guard having a grooved surface on a vertical portion of the guard;

b. a first pair of collets mounted on an upper and lower section of the pin guard;

c. a pair of drive screws having a longitudinal bore to allow the upper and lower sections of the pin guard to pass through and mounted on said sections adjacent the first pair of collets;

d. a second pair of collets mounted adjacent the drive screws retaining the drive screws on the pin guard;

e. a pair of flexible bands installed over a threaded portion of each drive screw to extend substantially parallel to the vertical section of the pin guard;

f. a pair of horizontally mounted flexible bands mounted between the pin guard grooves and the bracket;

g. a plurality of sight pins affixed to the bracket, each having an elongate section and a pin head, such that the pin head and a target may be boxed between the flexible bands by rotation of one drive screw; and wherein h. the drive screws and vertical flexible bands may be fixed by tightening a set screw in each drive screw affixing it to the pin guard.

* * * * *